US011101570B2

(12) United States Patent
Mercer et al.

(10) Patent No.: US 11,101,570 B2
(45) Date of Patent: Aug. 24, 2021

(54) PROJECTED GEOMETRY ANTENNA ARRAY

(71) Applicant: Microsoft Technology Licensing, LLC, Redmond, WA (US)

(72) Inventors: Sean Russell Mercer, Issaquah, WA (US); Nahal Niakan, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 5 days.

(21) Appl. No.: 16/692,369

(22) Filed: Nov. 22, 2019

(65) Prior Publication Data

US 2021/0159606 A1 May 27, 2021

(51) Int. Cl.

| | |
|---|---|
| ***H01Q 21/00*** | (2006.01) |
| ***H01Q 1/24*** | (2006.01) |
| ***H01Q 3/34*** | (2006.01) |
| ***H01Q 21/24*** | (2006.01) |

(Continued)

(52) U.S. Cl.

CPC ..... *H01Q 21/0025* (2013.01); *H01Q 1/243* (2013.01); *H01Q 1/526* (2013.01); *H01Q 3/34* (2013.01); *H01Q 21/0068* (2013.01); *H01Q 21/24* (2013.01); *H01Q 9/0407* (2013.01)

(58) Field of Classification Search

CPC ..... H01Q 21/0025; H01Q 1/526; H01Q 3/34; H01Q 21/24; H01Q 21/0068; H01Q 9/0407; H01Q 1/24; H01Q 1/241; H01Q 1/242; H01Q 1/243; H01Q 1/244; H01Q 1/245

See application file for complete search history.

(56) References Cited

U.S. PATENT DOCUMENTS

| | | | | |
|---|---|---|---|---|
| 8,921,709 | B2 * | 12/2014 | Koeppel | H05K 9/0007 174/261 |
| 9,041,074 | B2 | 5/2015 | Hong et al. | |
| 10,013,038 | B2 * | 7/2018 | Mercer | G06F 1/1654 |

(Continued)

FOREIGN PATENT DOCUMENTS

| | | | |
|---|---|---|---|
| CN | 104617382 | B | 9/2017 |
| CN | 108808214 | A | 11/2018 |
| CN | 109687165 | A | 4/2019 |

OTHER PUBLICATIONS

Kähkcönen, et al., "Dielectric-Filled Waveguide Antenna Array for Millimeter-Wave Communications", In Proceedings of 11th European Conference on Antennas and Propagation (EUCAP), Mar. 19, 2017, pp. 2767-2770.

(Continued)

*Primary Examiner* — Vibol Tan

(74) *Attorney, Agent, or Firm* — Holzer Patel Drennan

(57) ABSTRACT

An integrated antenna array device includes a circuitry component layer having bounds defining a circuitry zone. The circuitry component layer includes beam steering circuitry. The integrated antenna array device also includes an antenna component layer affixed to the circuitry component layer in the circuitry zone. The antenna component layer includes a radiating region and an interconnecting region. The radiating region is outside the circuitry zone and includes one or more antenna arrays having radiating antenna elements. The interconnecting region is substantially defined within the circuitry zone and interconnects the beam steering circuitry with the one or more radiating elements.

20 Claims, 13 Drawing Sheets

(51) Int. Cl.
*H01Q 1/52* (2006.01)
*H01Q 9/04* (2006.01)

(56) References Cited

U.S. PATENT DOCUMENTS

| | | | | |
|---|---|---|---|---|
| 10,418,687 | B2 * | 9/2019 | Mow | H01Q 21/065 |
| 10,454,539 | B2 * | 10/2019 | Takano | H04J 1/00 |
| 10,594,028 | B2 * | 3/2020 | Yong | H01Q 1/38 |
| 10,608,321 | B2 * | 3/2020 | Jiang | H01Q 9/0421 |
| 2016/0226131 | A1 | 8/2016 | Mcmilin et al. | |
| 2017/0126292 | A1 * | 5/2017 | Takano | H04B 17/318 |
| 2017/0294705 | A1 | 10/2017 | Khripkov et al. | |
| 2017/0309992 | A1 * | 10/2017 | Noori | H01Q 1/2258 |
| 2018/0026341 | A1 | 1/2018 | Mow et al. | |
| 2018/0088225 | A1 * | 3/2018 | Karls | H04W 72/046 |
| 2019/0027808 | A1 | 1/2019 | Mow et al. | |
| 2019/0131691 | A1 | 5/2019 | Hong et al. | |
| 2019/0252771 | A1 * | 8/2019 | Yong | H01Q 21/065 |

OTHER PUBLICATIONS

"International Search Report & Written Opinion issued in PCT Application No. PCT/US20/059237", dated Feb. 12, 2021, 14 Pages.

* cited by examiner

PROJECTED GEOMETRY ANTENNA ARRAY

BACKGROUND

Industrial design objectives for mobile communication devices continue to shrink the bezel area between the display and the edge of the device. However, antenna placement and operation in some configuration require the positioning of multiple and varied antennas within this ever-shrinking volume in the bezel. Moreover, some configurations of mmWave antenna technologies can require at least beam steering circuitry (and potentially a portion of the transceiver circuitry) to be in the same module as the corresponding antenna array, which can increase the competition for the valuable bezel volume.

SUMMARY

The described technology provides an integrated antenna array device including a circuitry component layer having bounds defining a circuitry zone. The circuitry component layer includes beam steering circuitry. The integrated antenna array device also includes an antenna component layer affixed to the circuitry component layer in the circuitry zone. The antenna component layer includes a radiating region and an interconnecting region. The radiating region is outside the circuitry zone and includes one or more antenna arrays having radiating antenna elements. The interconnecting region is substantially defined within the circuitry zone and interconnects the beam steering circuitry with the one or more radiating elements.

The described technology also provides a communication device having an interior and an exterior. The communication device includes a radiofrequency (RF) shielding display assembly on a display side of the communication device. A bezel region on the display side of the communication device between the RF shielding display assembly and an edge of the communication device is capable of passing RF radiation between the interior and the exterior of the communication device. An integrated antenna array device includes a circuitry component layer having bounds defining a circuitry zone. The circuitry component layer includes beam steering circuitry (and potentially transceiver circuitry). The integrated antenna array device also includes an antenna component layer affixed to the circuitry component layer in the circuitry zone. The antenna component layer includes a radiating region and an interconnecting region. The radiating region is outside the circuitry zone and includes one or more antenna arrays having radiating antenna elements. The interconnecting region is substantially defined within the circuitry zone and interconnects the beam steering circuitry with the one or more radiating elements. The one or more radiating elements are positioned in the bezel region of the communication device to allow the passing of RF radiation between the interior and the exterior of the communication device through the bezel region.

This summary is provided to introduce a selection of concepts in a simplified form that is further described below in the Detailed Description. This summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

FIG. 1 illustrates an example communication device including an example projected geometry antenna array component device.

FIG. 2*a* illustrates a cross-sectional view of an example projected geometry antenna array component device, and FIG. 2*b* illustrates a front view of the projected geometry antenna array component device.

Figures 6A, 6B:
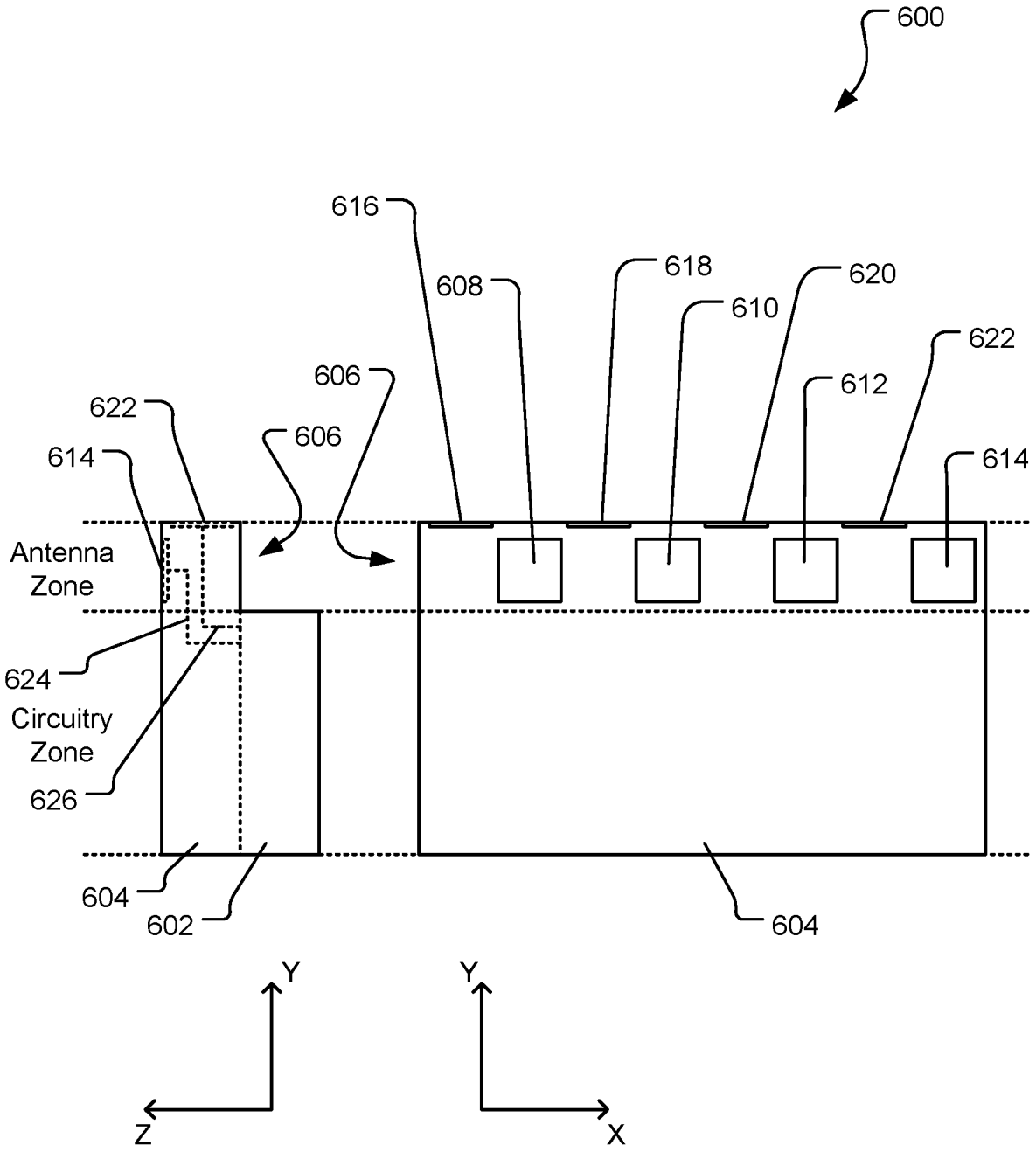

FIG. 6*a* illustrates a side view of an example projected geometry antenna array component device having two antenna arrays radiating in different directions, and FIG. 6*b* illustrates a front view of the projected geometry antenna array component device.

Figure 7:
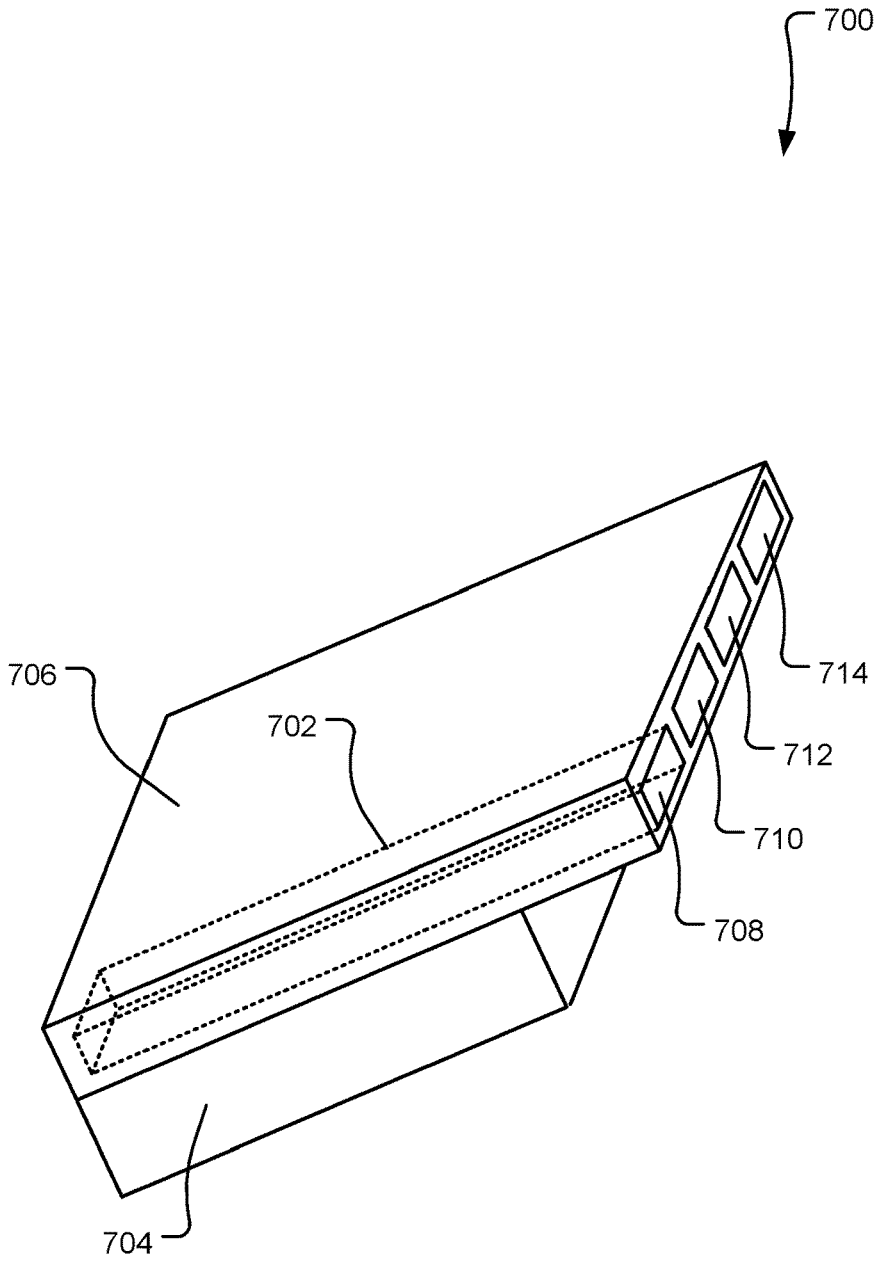

FIG. 7 illustrates a perspective view of an example projected geometry antenna device having a waveguide antenna shown in dashed lines in a first geometry.

Figure 8:
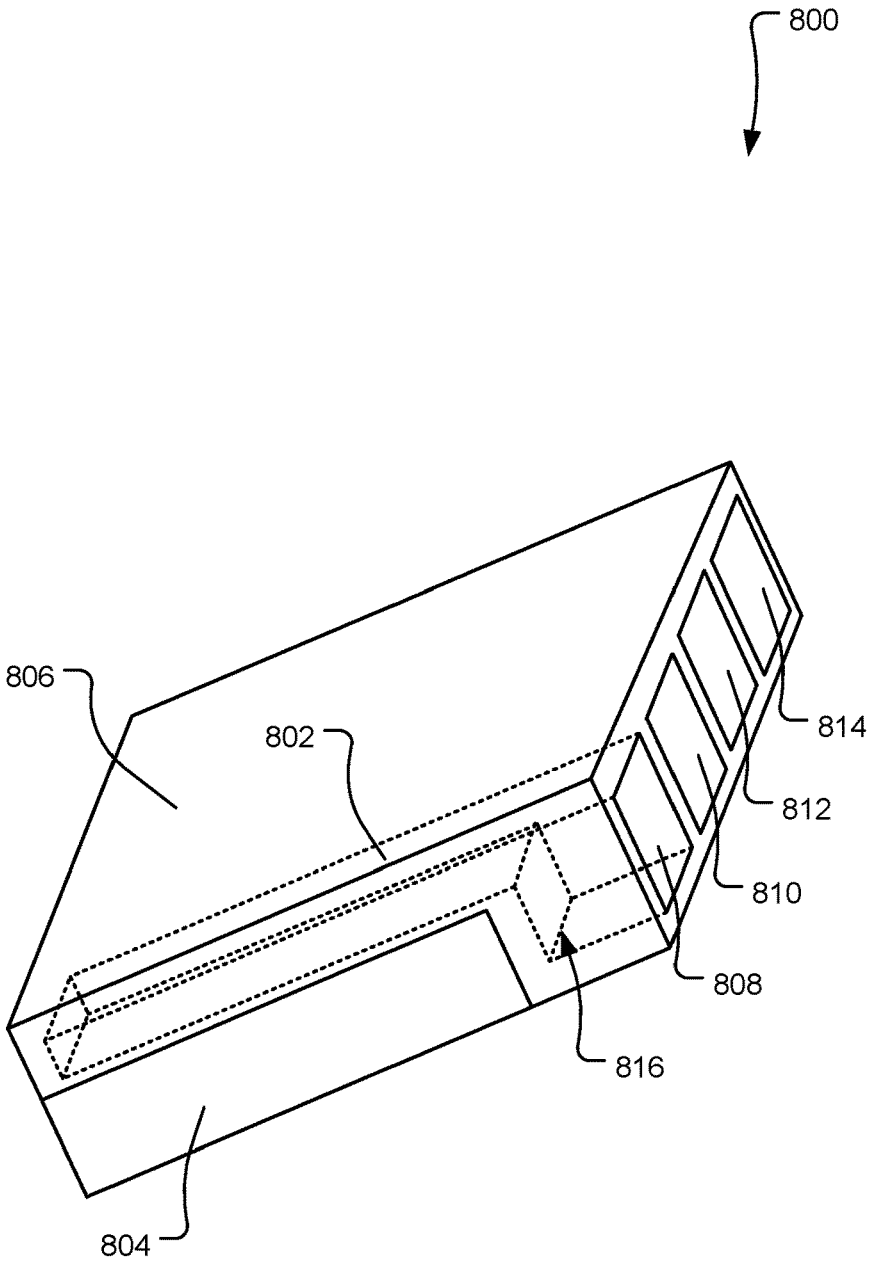

FIG. 8 illustrates a perspective view of an example projected geometry antenna device having a waveguide antenna shown in dashed lines in a second geometry.

Figure 9:
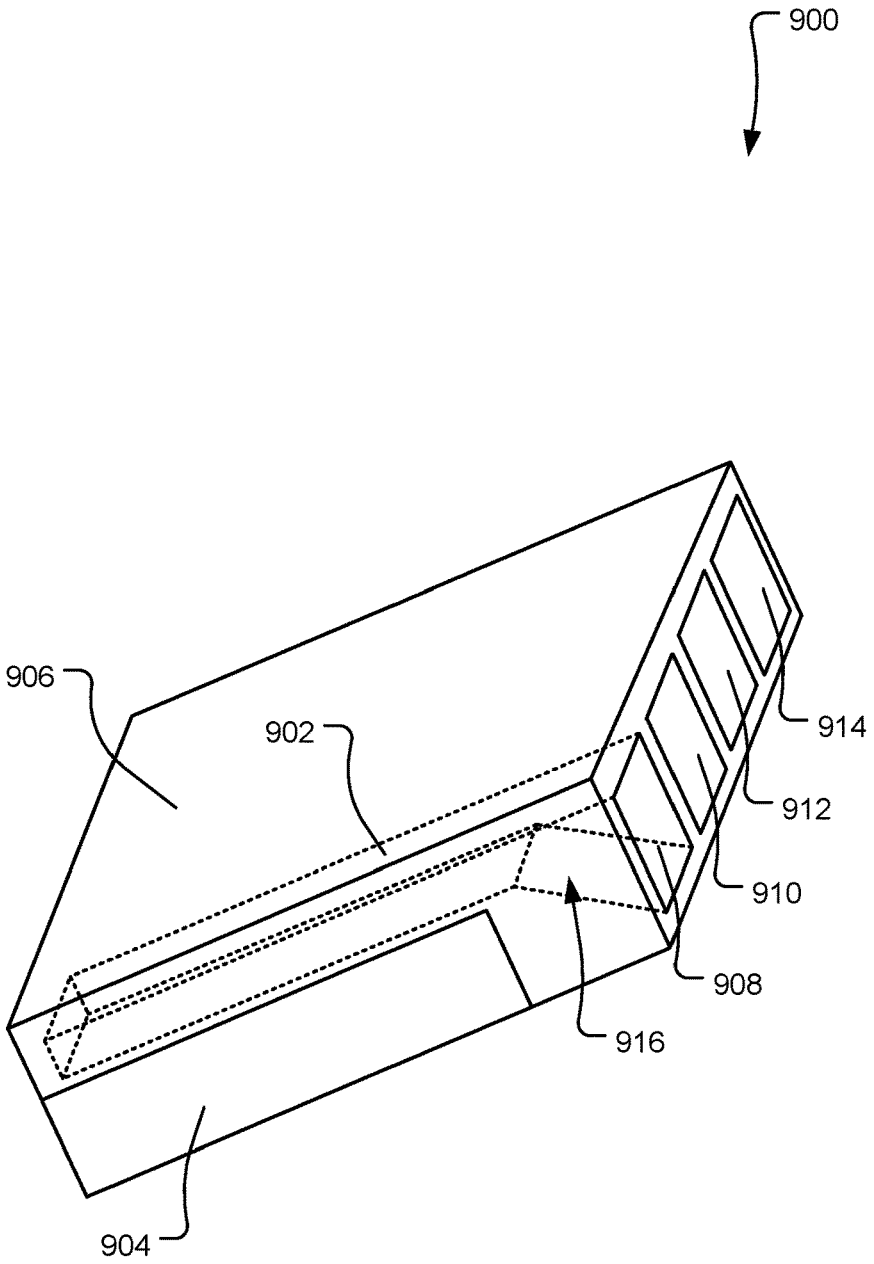

FIG. 9 illustrates a perspective view of an example projected geometry antenna device having a waveguide antenna shown in dashed lines in a third geometry.

Figure 10A:
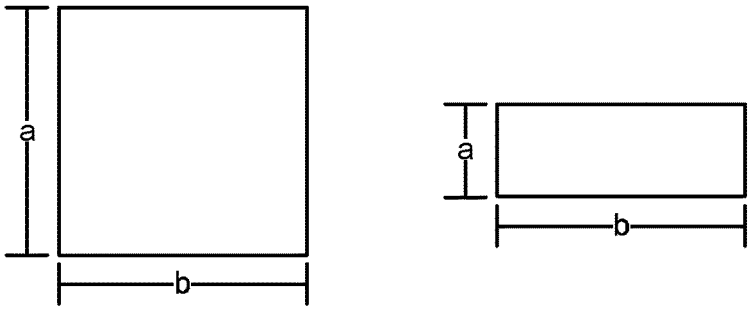
Figure 10B:
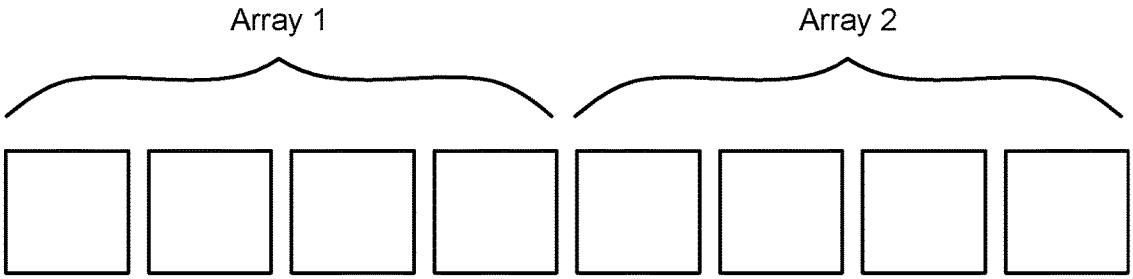
Figure 10C:
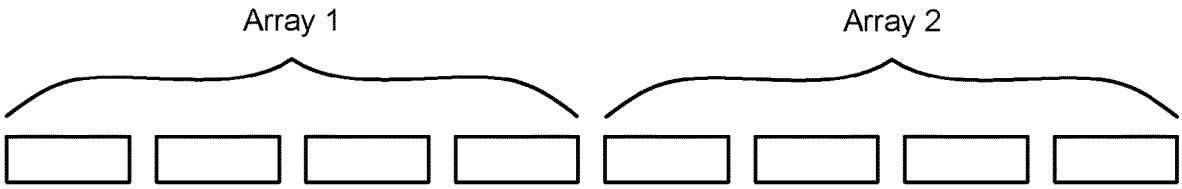
Figure 10D:
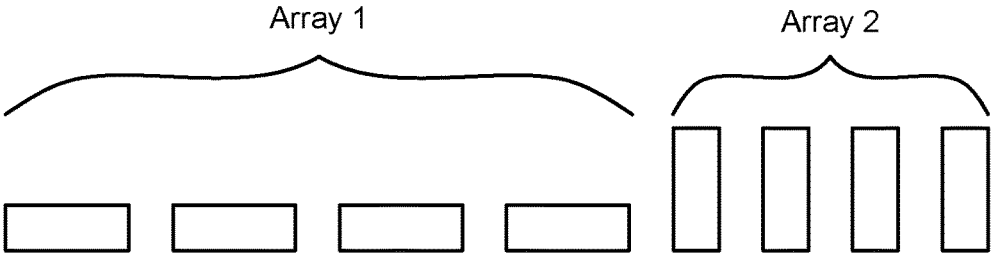

FIG. 10*a* illustrates example shapes of radiating apertures of a waveguide antenna at a surface of a projected geometry antenna array component device; FIG. 10*b* illustrates radiating apertures of two example waveguide antenna arrays at a surface of a projected geometry antenna array component device; FIG. 10*c* illustrates radiating apertures of another two example waveguide antenna arrays at a surface of a projected geometry antenna array component device; and FIG. 10*d* illustrates radiating apertures of yet another two example waveguide antenna arrays at a surface of a projected geometry antenna array component device.

Figures 11A, 11B:
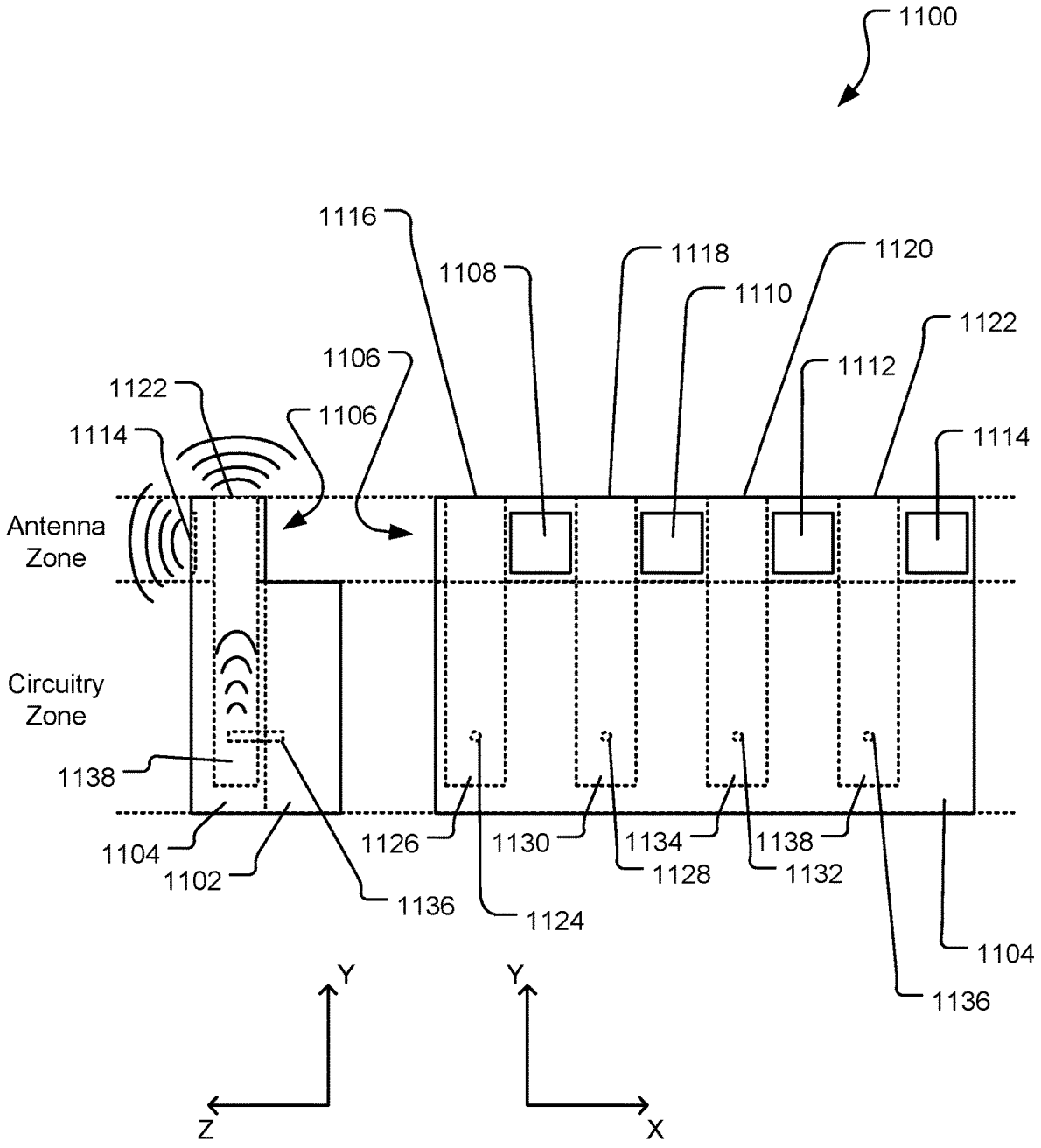

FIG. 11*a* illustrates a side view of an example projected geometry antenna array component device having two antenna arrays radiating in different directions, and FIG. 11*b* illustrates a front view of the projected geometry antenna array component device. wherein one of the antenna arrays includes waveguide antennas.

Figure 12:
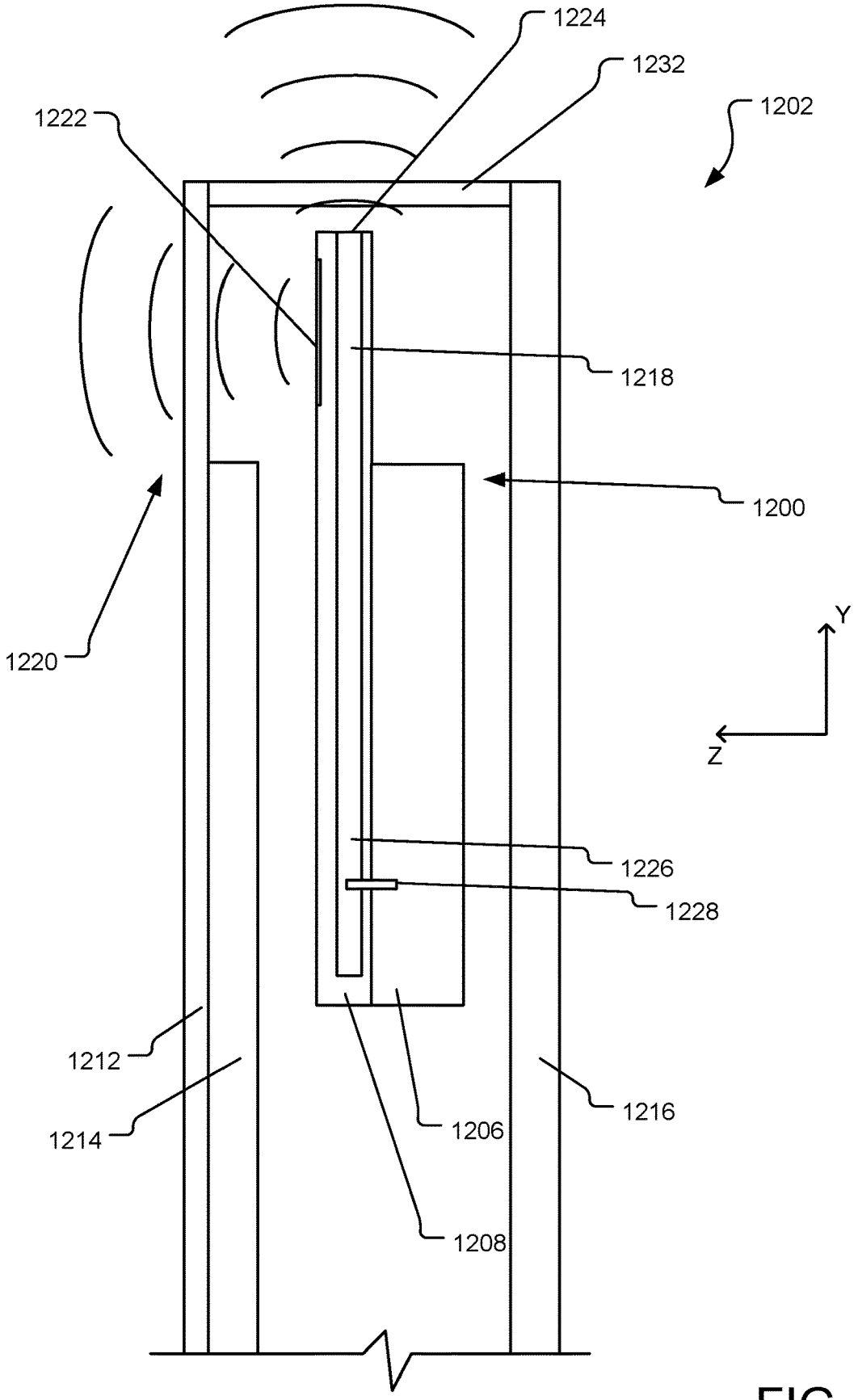

FIG. 12 illustrates a cross-sectional view of an example projected geometry antenna array component device installed in a communication device and having two directional radiating antennas, wherein one of the antenna arrays includes waveguide antennas.

Figure 13:
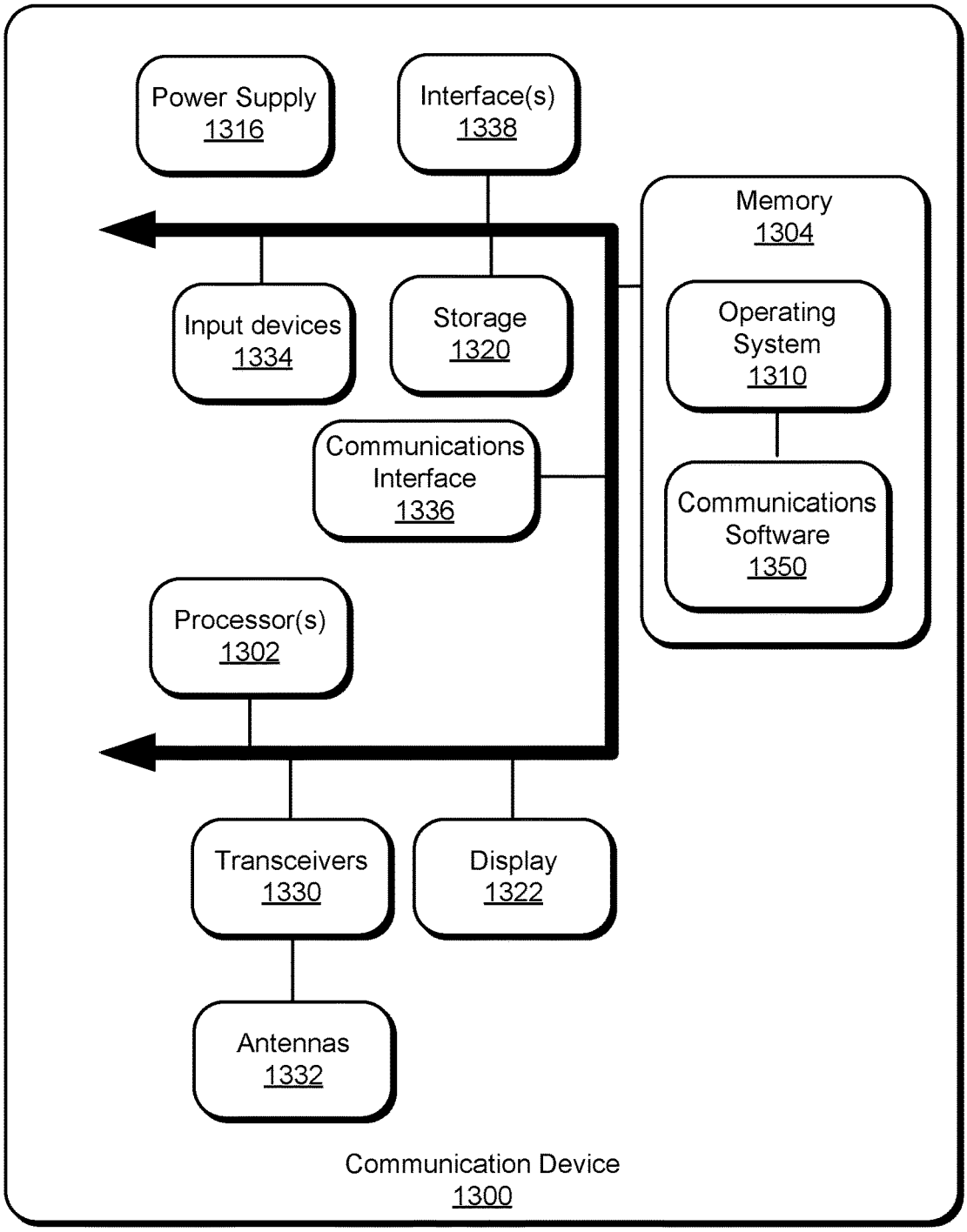

FIG. 13 illustrates an example operating environment and system for a projected geometry antenna array component device.

DETAILED DESCRIPTIONS

In at least one implementation of the described technology, an integrated antenna array device includes a circuitry component layer having bounds defining a circuitry zone on a first axis and a second axis, the first and second axes being mutually orthogonal, the circuitry component layer including beam steering circuitry. Furthermore, an integrated antenna array device includes an antenna component layer affixed to the circuitry component layer in the circuitry zone on a third axis, the third axis being mutually orthogonal to the first and second axes, the antenna component layer including a radiating region and an interconnecting region, the radiating region being outside the circuitry zone and including one or more antenna arrays having radiating antenna elements, the interconnecting region being substantially defined within the circuitry zone and interconnecting the beam steering circuitry with the radiating antenna elements.

Figure 1:
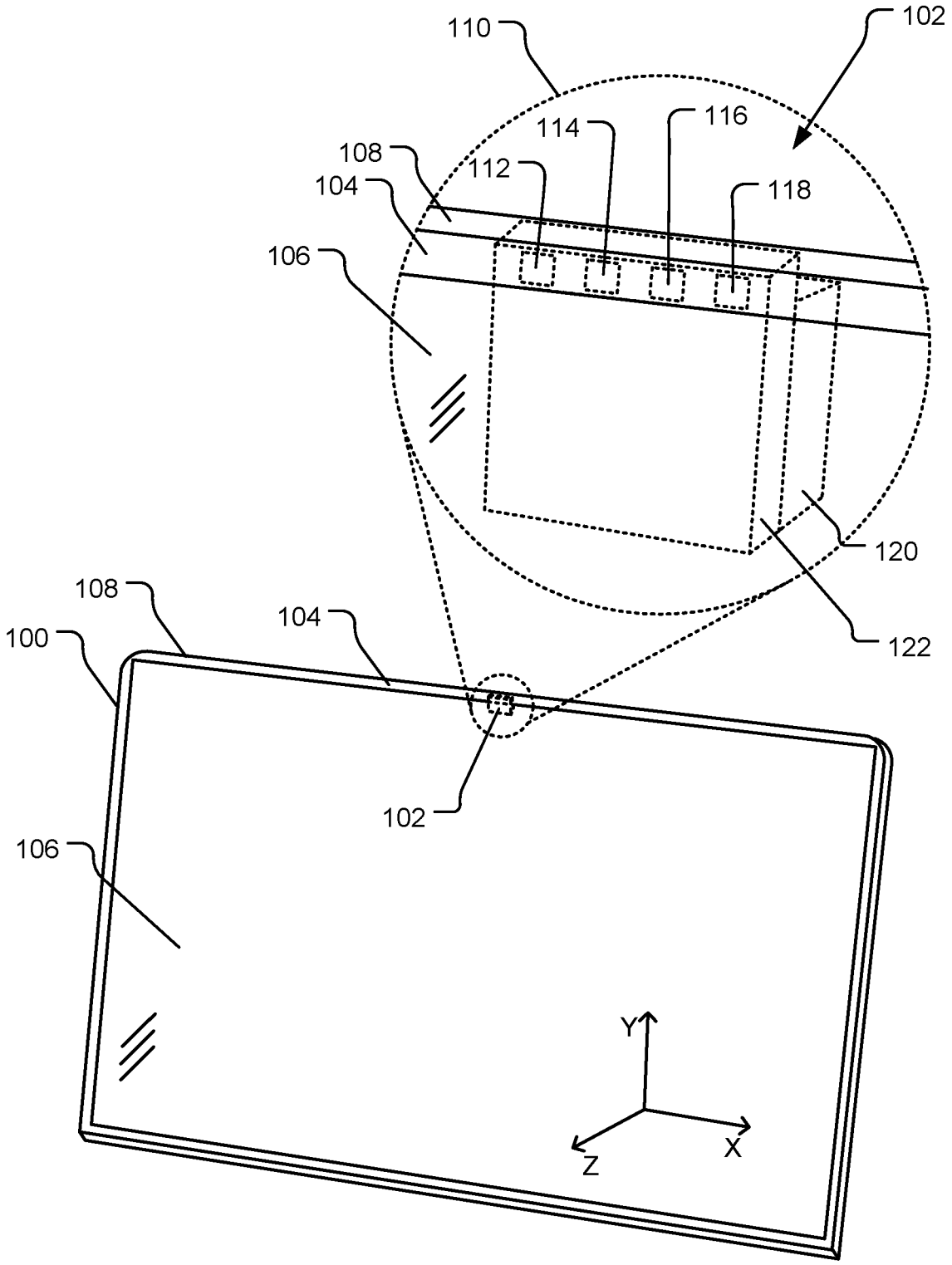

FIG. 1 illustrates an example communication device 100 including an example projected geometry antenna array component device 102 as an integrated antenna array device. The dashed lines indicate that the corresponding structure is located behind a surface of the communication device 100. A three-dimensional axis system is shown with respect to the communication device 100 to provide example directional relationships among different components in the communication device 100.

The projected geometry antenna array component device 102 is positioned at a bezel region 104 between a display 106 of the communication device 100 and an edge 108 of the communication device 100. In this example, the edge 108 is a top edge, but other edges may be employed. Furthermore, the projected geometry antenna array component device 102 is shown in the center (along the X-axis) of the communication device 100, but the projected geometry antenna array component device 102 may be positioned at any distance along the edge 108 or any other edge or corner of the communication device 100.

The display 106 and some of its constituent components (collectively, the "display assembly") act to substantially shield radiofrequency (RF) radiation from exiting the communication device 100. In this manner, the display assembly is considered "RF opaque" with respect to RF radiation passing between the interior and exterior of the communication device 100, although this term may apply to materials or components that do not block all such radiation (e.g., a material blocking substantially all or most of the RF radiation may be considered RF opaque).

Accordingly, the projected geometry antenna array component device 102 is positioned at the bezel region 104 in which the shielding material is not located. Instead, the bezel region 104 is considered "RF transparent" because it passes most or all of the RF radiation passing between the interior and exterior of the communication device 100, although this term may apply to materials or components that do block some amount of such radiation (e.g., a material passing substantially all or most of the RF radiation may be considered RF transparent or even RF translucent). As shown in the expanded view 110, the projected geometry antenna array component device 102 is positioned near the edge 108 of the communication device 100, with antenna array elements 112, 114, 116, and 118 positioned in the bezel region 104 so that RF radiation may pass between the interior and exterior of the communication device 100 through the RF transparent bezel region 104.

The projected geometry antenna array component device 102 includes a circuitry component layer 120, including at least beam steering circuitry (and potentially transceiver circuitry) for operating antenna array elements 112, 114, 116, and 118 of the projected geometry antenna array component device 102. Such beam steering circuitry (and potentially, transceiver circuitry) is typically located within a shield can (not shown). In one implementation, the beam steering circuitry includes, for each antenna array element, a phase shifter in the circuitry component layer 120. In another implementation, transceiver circuitry is added to the beam steering circuitry in the circuitry component layer 120, for each antenna array element, wherein the transceiver circuitry includes a transmitting channel (e.g., including a transmitting amplifier and a transmitting mixer) and a receiving channel (e.g., including a receiving amplifier and a receiving mixer), although other configurations are contemplated.

The circuitry component layer 120 is affixed to (e.g., through bonding, soldering, ceramic deposition, thin film deposition, or adhesives) an antenna component layer 122. The combination of the circuitry component layer 120 and the antenna component layer 122 form a component device that can be installed in the communication device 100. The antenna component layer 122 extends beyond the dimensions of the circuitry component layer 120 (in the Y-direction in this illustrated configuration) in a portion that includes the four antenna array elements 112, 114, 116, and 118 of the projected geometry antenna array component device 102. The portion of the antenna component layer 122 that extends beyond the dimensions of the circuitry component layer 120 defines an "antenna zone," including one or more antenna array elements. When the projected geometry antenna array component device 102 is positioned within the communication device 100, the antenna zone is projected into the bezel region 104 to allow RF radiation from the antenna array elements 112, 114, 116, and 118 to pass between the interior and exterior of the communication device 100 through the RF transparent bezel region 104. In contrast, the portion of the antenna component layer 122 that substantially overlaps the dimensions of the circuitry component layer 120 defines a "circuitry zone." In various implementations, the circuitry zone does not include antenna elements intended to radiate through the bezel region 104 between the interior and exterior of the communication device 100.

If the antenna elements are all directional, then the configuration shown in FIG. 1 provides one direction of RF radiation (i.e., out the front of the bezel region 104 along the Z-axis). Alternatively, the antenna arrays may include omnidirectional antenna elements. In radio communication, an omnidirectional antenna is a class of antenna that radiates and/or receives substantially equal radio power in all directions perpendicular to an axis (i.e., in azimuthal directions), with power varying with the angle to the axis (elevation angle), declining substantially to zero on the axis. It should be understood that some omnidirectional antenna configurations can yield directional radiation (e.g., not substantially equal radio power in all directions perpendicular to an axis) when augmented by a proximate coupling element (e.g., a nearby ground plane). This is in contrast to an isotropic antenna that radiates and/or receives substantially equally in all directions and to a directional antenna radiates and/or receives greater power in specific directions, thereby allowing increased performance in those specific directions and reducing interference from unwanted sources in other directions. Directional antennas can provide increased performance over dipole antennas—or omnidirectional antennas, in general—when a greater concentration of radiation in a certain direction is desired. Omnidirectional and directional antennas may be used in combination in the same communication device.

Figures 2A, 2B:
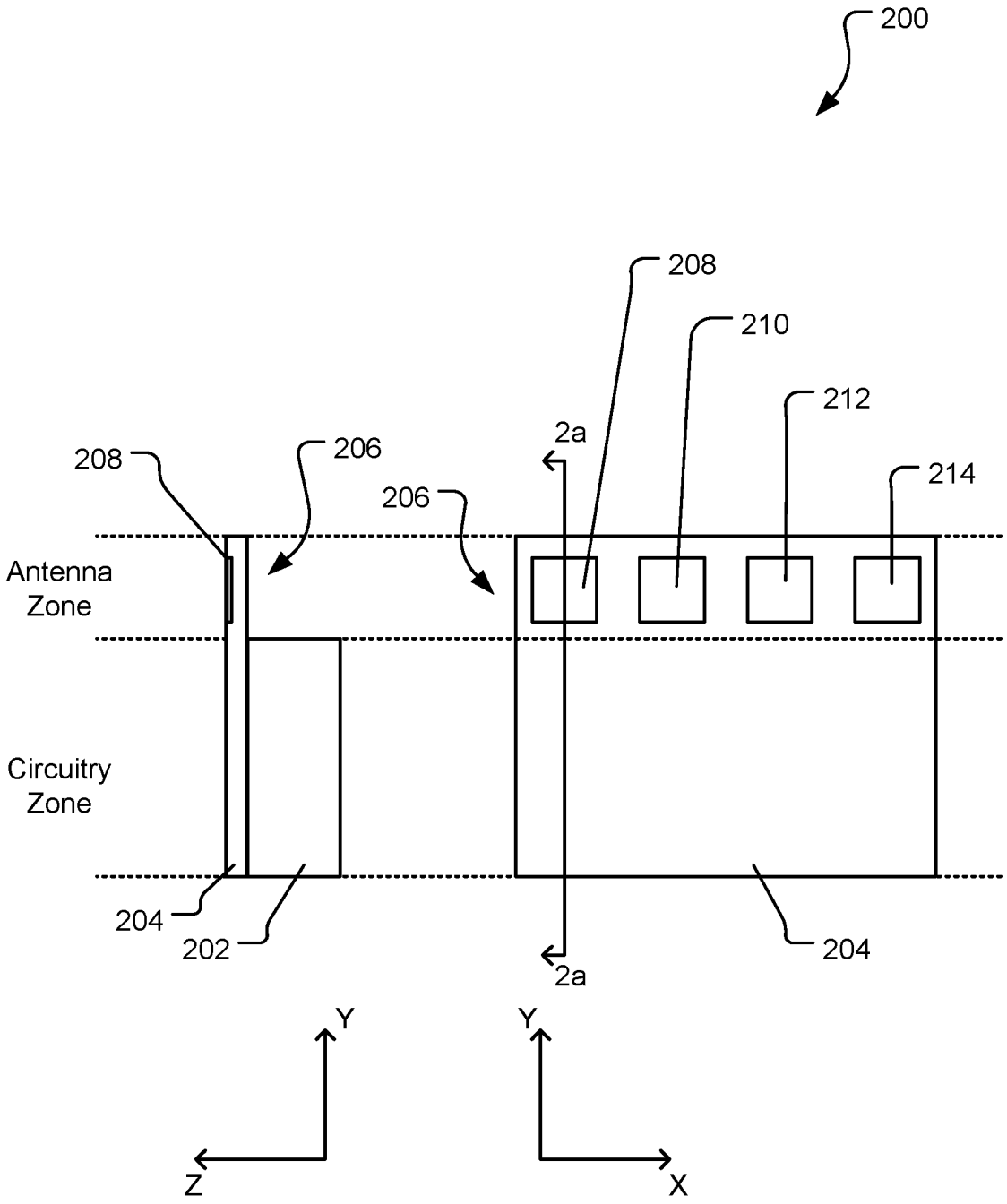

FIG. 2*a* illustrates a cross-sectional view of an example projected geometry antenna array component device 200, and FIG. 2*b* illustrates a front view of the projected geometry antenna array component device 200. In FIG. 2*a*, the projected geometry antenna array component device 200, as an integrated antenna array device, includes a circuitry component layer 202 and an antenna component layer 204. A portion 206 of the antenna component layer 204 extends beyond the dimensions of the circuitry component layer 202. The portion of the antenna component layer 204 that overlaps the circuitry component layer 202 substantially defines an interconnection region. The portion of the antenna component layer 204 that includes radiating antenna elements substantially defines the radiating region and does not overlap the circuitry component layer 202. In FIG. 2*b*, the circuitry component layer 202 is hidden behind the antenna component layer 204 in the circuitry zone.

In the antenna zone, the antenna component layer 204 includes four antenna array elements 208, 210 212, and 214. The antenna array elements may be directional or omnidirectional. An example directional antenna element is a patch antenna, which is backed by a ground plane. Example omnidirectional antennas include without limitation monopole antennas, dipole antennas, slot antennas, and Yagi antennas, although such antennas may be made to provide more directional radiation in the proximity of a ground plane.

The circuitry component layer 202 includes beam steering circuitry (as described previously) to drive the antenna array elements 208, 210 212, and 214. The antenna component layer 204 includes an interconnection region between the circuitry component layer 202 and the individual antenna array elements to allow transmitting and receiving signals to be communicated between them (interconnecting elements not shown in FIG. 2). In one implementation, the interconnection region includes a multilayer substrate, such as a multi-layer low-temperature co-fired ceramic substrate or a multi-layer RF substrate, although other interconnection substrates may be employed.

Figure 3:
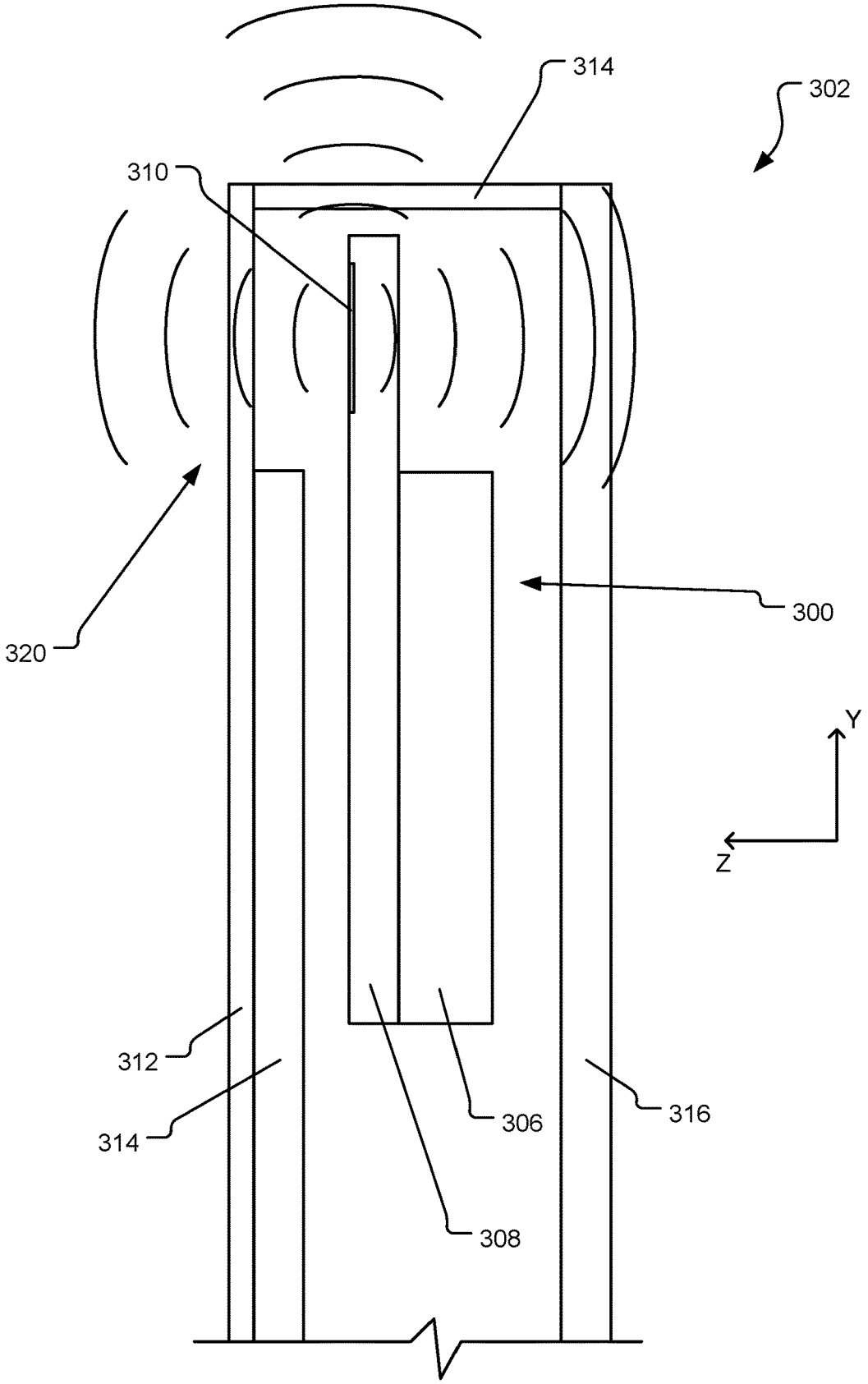
FIG. 3 illustrates a cross-sectional view of an example projected geometry antenna array component device installed in a communication device and having an omni-directionally radiating antenna.

FIG. 3 illustrates a cross-sectional view of an example projected geometry antenna array component device 300 installed in a communication device 302 and having an omnidirectionally radiating antenna element 310.

The projected geometry antenna array component device 300, as an integrated antenna array device includes a circuitry component layer 306 and an antenna component layer 308, the latter of which includes an antenna array (see the omnidirectional antenna element 310, e.g., a monopole antenna, a dipole antenna, a slot antenna). The RF radiation represented by the curved sequences of lines extends from the antenna array over more than a 90-degree angle.

The portion of the antenna component layer 308 that overlaps the circuitry component layer 306 substantially defines an interconnection region. The portion of the antenna component layer 308 that includes radiating antenna elements substantially defines the radiating region and does not overlap the circuitry component layer 306.

The communication device 302 includes a display cover glass 312, which is RF transparent, as is the edge surface 314 and the back surface 316 of the communication device case. A display assembly 318 is positioned some distance from the top edge of the communication device 302, and this RF transparent distance defines the RF transparent bezel region 320. In contrast, the display assembly 318 is not RF transparent and, therefore, will block all or most of the RF radiation from passing through the display assembly 318 between the interior and exterior of the communication device 302. Accordingly, all or more of the RF radiation may pass between the interior and exterior of the communication device 302 through the RF transparent bezel region 320. By positioning the antenna zone of the projected geometry antenna array component device 300 within the RF transparent bezel region 320, the omnidirectional RF radiation emitted from (and received by) the antenna element 310 may pass between the interior and exterior of the communication device 302 through cover glass 312 within the RF transparent bezel region 320 and through the RF transparent material of the edge surface 314 and the back surface 316 of the communication device case.

Figure 4:
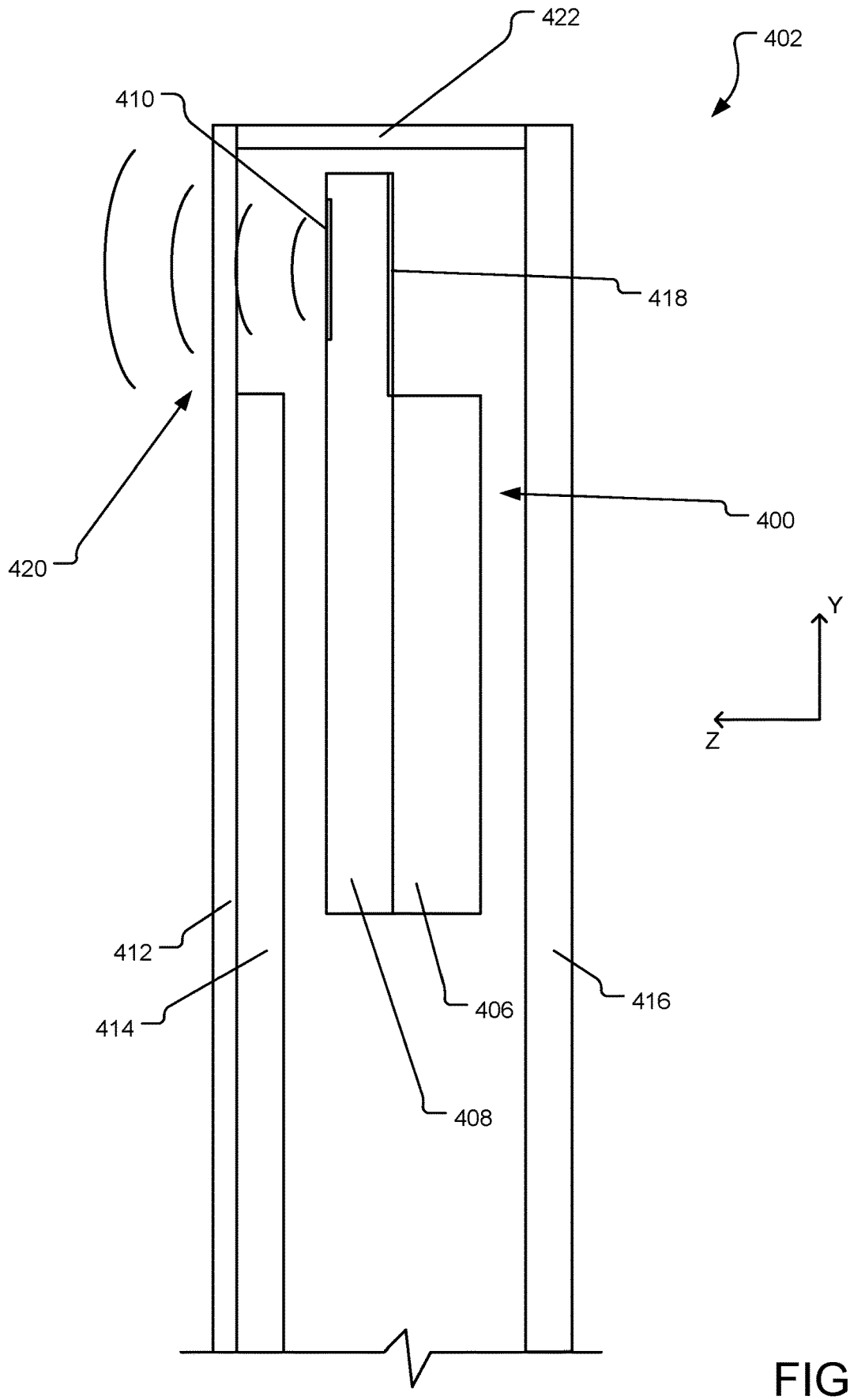
FIG. 4 illustrates a detailed cross-sectional view of an example projected geometry antenna array component device installed in a communication device and having a directionally radiating antenna.

FIG. 4 illustrates a cross-sectional view of an example projected geometry antenna array component device 400 installed in a communication device 402 and having a directionally radiating antenna element 410 (see the patch antenna).

The projected geometry antenna array component device 400, as an integrated antenna array device, includes a circuitry component layer 406 and an antenna component layer 408, the latter of which includes an antenna array with the directional antenna element 410 (see, e.g., the patch antenna with a nearby ground plane 418). The RF radiation represented by the curved sequences of lines extends from the antenna array within less than a 90-degree angle.

The portion of the antenna component layer 408 that overlaps the circuitry component layer 406 substantially defines an interconnection region. The portion of the antenna component layer 408 that includes radiating antenna elements substantially defines the radiating region and does not overlap the circuitry component layer 406.

The communication device 402 includes a display cover glass 412, which is RF transparent, as is the edge surface 422 and the back surface 416 of the communication device case. A display assembly 414 is positioned some distance from the top edge surface 422 of the communication device 402, and this RF transparent distance defines the RF transparent bezel region 420. In contrast, the display assembly 414 is not RF transparent and, therefore, will block all or most of the RF radiation from passing through the display assembly 414 between the interior and exterior of the communication device 402. Accordingly, all or more of the RF radiation may pass between the interior and exterior of the communication device 402 through the RF transparent bezel region 420. By positioning the antenna zone of the projected geometry antenna array component device 400 within the RF transparent bezel region 420, the omnidirectional RF radiation emitted from (and received by) the antenna element 410 may pass between the interior and exterior of the communication device 402 through cover glass 412 within the RF transparent bezel region 420.

It should be understood that subject to thickness constraints imposed by the design of the communication device 402, a second antenna component layer may be positioned on the opposite side of the circuitry component layer 406 to provide directional RF radiation in the opposite direction of that from the antenna element 410. Other configurations to provide multiple antenna arrays and supplemental RF radiation directions are contemplated as taught in the multiple implementations described herein.

Figure 5:
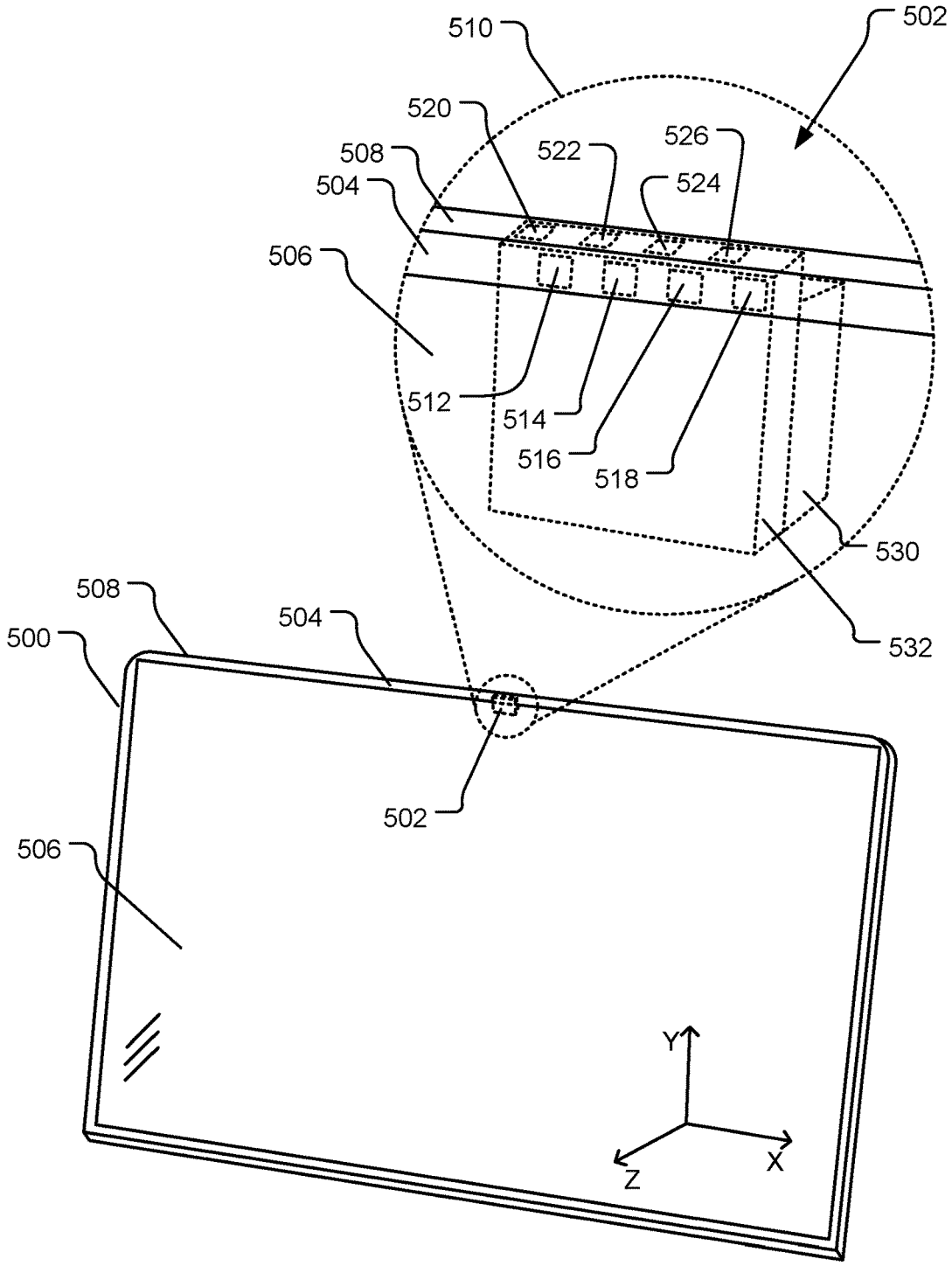
FIG. 5 illustrates an example computing system including an example projected geometry antenna array having two antenna arrays radiating in different directions.

FIG. 5 illustrates an example communication device 500 including an example projected geometry antenna array component device 502 having two antenna arrays radiating in different directions. The dashed lines indicate that the corresponding structure is located behind a surface of the communication device 500. A three-dimensional axis system is shown with respect to the communication device 500 to provide example directional relationships among different components in the communication device 500.

The projected geometry antenna array component device 502, as an integrated antenna array device, is positioned at a bezel region 504 between a display 506 of the communication device 500 and an edge 508 of the communication device 500. In this example, the edge 508 is a top edge, but other edges may be employed. Furthermore, the projected geometry antenna array component device 502 is shown in the center (along the X-axis) of the communication device 500, but the projected geometry antenna array component device 502 may be positioned at any distance along the edge 508 or any other edge or corner of the communication device 500.

The display 506 and some of its constituent components (collectively, the "display assembly") act to substantially shield radiofrequency (RF) radiation from exiting the communication device 500. In this manner, the display assembly is considered "RF opaque" with respect to RF radiation passing between the interior and exterior of the communication device 500, although this term may apply to materials or components that do not block all such radiation (e.g., a material blocking substantially all or most of the RF radiation may be considered RF opaque).

Accordingly, the projected geometry antenna array component device 502 is positioned at the bezel region 504 in which the shielding material is not located. Instead, the bezel region 504 is considered "RF transparent" because it passes most or all of the RF radiation passing between the interior and exterior of the communication device 500, although this term may apply to materials or components that do block some amount of such radiation (e.g., a material passing substantially all or most of the RF radiation may be considered RF transparent or even RF translucent). As shown in the expanded view 510, the projected geometry antenna array component device 502 is positioned near the edge 508 of the communication device 500, with antenna array elements 512, 514, 516, and 518 positioned in the bezel region 504 so that RF radiation may pass between the interior and exterior of the communication device 500 through the RF transparent bezel region 504. In contrast to the projected geometry antenna array component device 102 shown in FIG. 1, the projected geometry antenna array component device 502 in FIG. 5 also includes antenna array elements 520, 522, 524, and 526 positioned at the edge 508 so that RF radiation may pass between the interior and exterior of the communication device 500 through RF transparent material in the edge 508.

The projected geometry antenna array component device 502 includes a circuitry component layer 530, including at least beam steering circuitry (and potentially transceiver circuitry) for operating antenna array elements 512, 514, 516, and 518 of the projected geometry antenna array component device 502. Such beam steering circuitry (and potentially, transceiver circuitry) is typically located within a shield can (not shown). In one implementation, the beam steering circuitry includes, for each antenna array element, a phase shifter in the circuitry component layer 530. In another implementation, transceiver circuitry is added to the beam steering circuitry in the circuitry component layer 530, for each antenna array element, wherein the transceiver circuitry includes a transmitting channel (e.g., including a transmitting amplifier and a transmitting mixer) and a receiving channel (e.g., including a receiving amplifier and a receiving mixer), although other configurations are contemplated.

The circuitry component layer 530 is affixed to (e.g., through bonding, soldering, ceramic deposition, thin film deposition, or adhesives) an antenna component layer 532. The combination of the circuitry component layer 530 and the antenna component layer 532 form a component device that can be installed in the communication device 500. The antenna component layer 532 extends beyond the dimensions of the circuitry component layer 530 (in the Y-direction in this illustrated configuration) in a portion that includes the four antenna array elements 512, 514, 516, and 518 of the projected geometry antenna array component device 502. The portion of the antenna component layer 532 that extends beyond the dimensions of the circuitry component layer 530 defines an "antenna zone," including one or more antenna array elements. When the projected geometry antenna array component device 502 is positioned within the communication device 500, the antenna zone is projected into the bezel region 504 to allow RF radiation from the antenna array elements 512, 514, 516, and 518 to pass between the interior and exterior of the communication device 500 through the RF transparent bezel region 504. In contrast, the portion of the antenna component layer 532 that substantially overlaps the dimensions of the circuitry component layer 530 defines a "circuitry zone." In various implementations, the circuitry zone does not include antenna elements intended to radiate through the bezel region 504 between the interior and exterior of the communication device 500.

If the antenna elements are all directional, then the configuration shown in FIG. 5 provides two directions of RF radiation (i.e., out the front of the bezel region 504 along the Z-axis and out the top of the edge 508 in the X-direction). Alternatively, one or both of the antenna arrays may include omnidirectional antenna elements. The antenna arrays positioned at different surfaces are shown as interleaved, but such interleaving is not necessary for all implementations.

FIG. 6*a* illustrates a side view of an example projected geometry antenna array component device having two antenna arrays radiating in different directions, and FIG. 6*b* illustrates a front view of the projected geometry antenna array component device. The dashed lines indicate that the corresponding structure is located behind another surface shown in the view.

In FIG. 6*a*, the projected geometry antenna array component device 600, as an integrated antenna array device, includes a circuitry component layer 602 and an antenna component layer 604. A portion 606 of the antenna component layer 604 extends beyond the dimensions of the circuitry component layer 602. In FIG. 6*b*, the circuitry component layer 602 is hidden behind the antenna component layer 604 in the circuitry zone.

The portion of the antenna component layer 604 that overlaps the circuitry component layer 602 substantially defines an interconnection region. The portion of the antenna component layer 604 that includes radiating antenna elements substantially defines the radiating region and does not overlap the circuitry component layer 602.

In the antenna zone, the antenna component layer 604 includes four antenna array elements 608, 610 612, and 614. Additionally, in the antenna zone, the antenna component layer 604 also includes four antenna array elements 616, 618, 620, and 622. The antenna array elements may be directional or omnidirectional.

An example directional antenna element is a patch antenna, which is backed by a ground plane. Example omnidirectional antennas include without limitation monopole antennas, dipole antennas, slot antennas, and Yagi antennas.

The circuitry component layer 602 includes beam steering circuitry (as described previously) to drive the antenna array elements 608, 610 612, 614, 616, 618, 620, and 622. The antenna component layer 604 includes an interconnection region between the circuitry component layer 602 and the individual antenna array elements to allow transmitting and receiving signals to be communicated between them. In one implementation, the interconnection region includes conductive interconnecting routes 624 and 626 (among others) in a multilayer substrate, such as a multi-layer low-temperature co-fired ceramic substrate or a multi-layer RF substrate, although other interconnection substrates may be employed. In another implementation, the interconnection region may include a waveguide connecting the beam steering circuitry to an array of radiating apertures in one or more surfaces in the antenna zone of the antenna component layer 604. In other implementations, conductive interconnecting routes and waveguides may be employed together.

If the antenna elements are all directional, then the configuration shown in FIG. 6 provides two directions of RF radiation (i.e., out the front of the bezel region of the communication device along the Z-axis and out the top of the edge of the communication device in the X-direction). Alternatively, one or both of the antenna arrays may include omnidirectional antenna elements. The antenna arrays positioned at different surfaces are shown as interleaved, but such interleaving is not necessary for all implementations.

FIG. 7 illustrates a perspective view of an example projected geometry antenna device 700, as an integrated antenna array device, having a waveguide 702 shown in dashed lines in a first geometry. The dashed lines indicate that the corresponding structure is located behind another surface shown in the view. The example projected geometry antenna device 700 includes a circuitry component layer 704 and an antenna component layer 706. The waveguide 702 includes a dielectric material encased in elongated conductive walls extending much of the length of the antenna component layer 706.

A radiating aperture 708 at the end of the waveguide 702 emits and receives RF radiation and is connected to beam steering circuitry in the circuitry component layer 704 via the waveguide 702 and a tap (not shown) that connects the beam steering circuitry to the waveguide 702. The other radiating apertures 710, 712, and 714 are also positioned at the end of similar waveguides (not shown). The radiating apertures 708, 710, 712, and 714, in an alternative implementation, may be rotated 90 degrees on the edge surface of the projected geometry antenna device 700, providing a 90 degree shifted polarization.

FIG. 8 illustrates a perspective view of an example projected geometry antenna device, as an integrated antenna array device, having a waveguide 802 shown in dashed lines in a second geometry. The dashed lines indicate that the corresponding structure is located behind another surface shown in the view. The example projected geometry antenna device 800 includes a circuitry component layer 804 and an antenna component layer 806. The waveguide 802 includes a dielectric material encased in elongated conductive walls extending much of the length of the antenna component layer 806.

A radiating aperture 808 at the end of the waveguide 802 emits and receives RF radiation and is connected to beam steering circuitry in the circuitry component layer 804 via the waveguide 802 and a tap (not shown) that connects the beam steering circuitry to the waveguide 802. The waveguide 802 includes an abrupt transition point 816 in which the thin rectangular profile of the waveguide 802 changes to a square profile toward the radiating aperture 808. The other radiating apertures 810, 812, and 814 are also positioned at the end of similar waveguides (not shown).

FIG. 9 illustrates a perspective view of an example projected geometry antenna device, as an integrated antenna array device, having a waveguide 902 shown in dashed lines in a third geometry. The dashed lines indicate that the corresponding structure is located behind another surface shown in the view. The example projected geometry antenna device 900 includes a circuitry component layer 904 and an antenna component layer 906. The waveguide 902 includes a dielectric material encased in elongated conductive walls extending much of the length of the antenna component layer 906.

A radiating aperture 908 at the end of the waveguide 902 emits and receives RF radiation and is connected to beam steering circuitry in the circuitry component layer 904 via the waveguide 902 and a tap (not shown) that connects the beam steering circuitry to the waveguide 902. The waveguide 902 includes a tapered transition region 916 in which the thin rectangular profile of the waveguide 902 changes to a square profile toward the radiating aperture 908. This waveguide 902 with a tapered transition region 916 may operate like a horn antenna. The other radiating apertures 910, 912, and 914 are also positioned at the end of similar waveguides (not shown).

FIG. 10*a* illustrates example shapes of radiating apertures of a waveguide antenna at a surface of a projected geometry antenna array component device as an integrated antenna array device; FIG. 10*b* illustrates radiating apertures of two example waveguide antenna arrays (Array 1 and Array 2) at a surface of a projected geometry antenna array component device; FIG. 10*c* illustrates radiating apertures of another two example waveguide antenna arrays (Array 1 and Array 2) at a surface of a projected geometry antenna array component device; and FIG. 10*d* illustrates radiating apertures of yet another two example waveguide antenna arrays (Array 1 and Array 2) at a surface of a projected geometry antenna array component device. The rotated relationship between the two arrays in FIG. 10*d* yields RF radiation with a horizontal polarization in Array 1 and RF radiation with a vertical polarization in Array 2.

FIG. 11*a* illustrates a side view of an example projected geometry antenna array component device having two antenna arrays radiating in different directions, and FIG. 11*b* illustrates a front view of the projected geometry antenna array component device. wherein one of the antenna arrays includes waveguide antennas. The dashed lines indicate that the corresponding structure is located behind another surface shown in the view.

In FIG. 11*a*, the projected geometry antenna array component device 1100, as an integrated antenna array device, includes a circuitry component layer 1102 and an antenna component layer 1104. A portion 1106 of the antenna component layer 1104 extends beyond the dimensions of the circuitry component layer 1102. In FIG. 11*b*, the circuitry component layer 1102 is hidden behind the antenna component layer 1104 in the circuitry zone.

The portion of the antenna component layer 1104 that overlaps the circuitry component layer 1102 substantially defines an interconnection region. The portion of the antenna component layer 1104 that includes radiating antenna elements substantially defines the radiating region and does not overlap the circuitry component layer 1102.

In the antenna zone, the antenna component layer 1104 includes four antenna array elements 1108, 1110, 1112, and 1114, which are shown as directional antennas, although they could alternatively include omnidirectional antennas. In FIG. 11, the antenna array elements 1116, 1118, 1120, and 1122 are depicted as dielectrically loaded waveguide antennas, which are configured to radiate at the thin edge (e.g., top edge) of the communication device.

The antenna array elements in various locations may be directional or omnidirectional. Example directional antenna elements include without limitation a patch antenna, which is backed by a ground plane, and a dielectrically loaded rectangular waveguide antenna. Example omnidirectional antennas include without limitation monopole antennas, dipole antennas, slot antennas, and Yagi antennas. In some implementations, more than one antenna array in a projected geometry antenna array component device may include dielectrically loaded rectangular waveguide antennas. Such antennas may support different polarizations (e.g., horizontal and vertical) and be integrated into an advanced module ceramic packaging that accommodates the waveguide antennas and the mmWave front end circuitry that drives the antenna elements.

In one implementation, the dielectrically loaded rectangular waveguide antenna elements (antenna array elements 1116, 1118, 1120, and 1122) may be fabricated from ceramic with a dielectric constant of 10, although other dielectric constant values may also be employed. Table 1 shows a selection of waveguide dimensions ('a' and 'b') for different values of dielectric loading in millimeter units.

TABLE 1

Example Dimensions and Corresponding Dielectric Constants

| Dielectric Constant | a | b |
|---|---|---|
| 1 | 7.112 | 3.556 |
| 3 | 4.106 | 1.755 |
| 4 | 3.556 | 1.886 |
| 6 | 2.903 | 2.087 |
| 10 | 2.249 | 2.371 |
| 22 | 1.516 | 2.888 |

Table 1 illustrates the positive size reductions of dielectrically loaded waveguides with different dielectric constants. The dimensions "a" and "b" for the air loaded waveguide (with a dielectric constant=1) represent the industry standard dimensions for a W28 waveguide, which is often used in 5G mmWave band products. As the dielectric constants increases, the dimensions can adjust accordingly (as shown in Table 1, for example). As such, by dielectrically loading the waveguide antenna elements, a total thickness of about 4 mm can be achieved while operating in at least the n360 and n261 frequency sub-band ranges (i.e., centered at 28 GHz and 39 GHz, respectively). Other dimensions and frequency ranges of operations are also achievable.

A broadband waveguide launch technique is employed as a feed structure for each dielectrically loaded waveguide antenna (antenna array element). The antenna array element 1116 is interconnected to the circuitry in the circuitry component layer 1102 via a tap 1124, which generates/detects an RF signal in the waveguide 1126. The antenna array element 1118 is interconnected to the circuitry in the circuitry component layer 1102 via a tap 1128, which generates/detects an RF signal in the waveguide 1130. The antenna array element 1120 is interconnected to the circuitry in the circuitry component layer 1102 via a tap 1132, which generates/detects an RF signal in the waveguide 1134. The antenna array element 1116 is interconnected to the circuitry in the circuitry component layer 1102 via a tap 1136, which generates/detects an RF signal in the waveguide 1138. Each dielectrically loaded waveguide antenna radiates from an aperture at an end of the waveguide, such as the apertures at the top edge of the projected geometry antenna array component device 1100.

The circuitry component layer 1102 includes beam steering circuitry (as described previously) to drive the antenna array elements 1108, 1110, 1112, 1114, 1116, 1118, 1120, and 1122. The antenna component layer 1104 includes an interconnection region between the circuitry component layer 1102 and the individual antenna array elements to allow transmitting and receiving signals to be communicated between them. In one implementation, the interconnection region includes conductive interconnecting routes (not shown) in a multilayer substrate, such as a multi-layer low-temperature co-fired ceramic substrate or a multi-layer RF substrate, although other interconnection substrates may be employed. In another implementation, the interconnection region may include a waveguide connecting the beam steering circuitry to an array of radiating apertures in one or more surfaces in the antenna zone of the antenna component layer 1104 (see, e.g., the portions of the waveguides in extending from the taps to the radiating apertures). In other implementations, conductive interconnecting routes and waveguides may be employed together.

If the antenna elements are all directional, then the configuration shown in FIG. 11 provides two directions of RF radiation (i.e., out the front of the bezel region of the communication device along the Z-axis and out the top of the edge of the communication device in the X-direction). The antenna arrays positioned at different surfaces are shown as interleaved, but such interleaving is not necessary for all implementations. Additional antenna arrays may be configured in other implementations, including directional and/or omnidirectional antenna elements.

FIG. 12 illustrates a cross-sectional view of an example projected geometry antenna array component device 1200 installed in a communication device 1202 and having two antenna arrays, wherein one of the antenna arrays includes waveguide antenna elements. One antenna array includes an antenna element 1222, and the other antenna array includes an antenna element 1224 (e.g., a radiating aperture of a dielectric-loaded waveguide antenna). In the illustrated implementation, the antenna element 1222 and the other antenna element 1224 are shown in the cross-sectional plane. In an alternative implementation, the antenna element 1222 and the other antenna element 1224 could be positioned so as not to overlap, in which case, they would not share the same cross-section plane.

The projected geometry antenna array component device 1200, as an integrated antenna array device, includes a circuitry component layer 1206 and an antenna component layer 1208. The antenna component layer 1208 includes an antenna array having one or more waveguides, e.g., a waveguide 1226. The waveguide 1226 includes elongated dielectric material (e.g., ceramic) encased in conductive walls, terminating at the top edge of the antenna component layer 1208 in a radiating aperture that operates as an antenna element 1224. The waveguide 1226 is fed from a tap 1228 connecting it to the beam steering circuitry in the circuitry component layer 1206. The antenna component layer 1208 also includes an antenna array with the antenna element 1222 (see, e.g., the patch antenna with a nearby ground plane formed from the conductive wall of the waveguide 1226). The patch antenna is fed from a conductive routing (not shown) connecting it to the beam steering circuitry in the circuitry component layer 1206. The antenna element 1222 is shown as a directional antenna, but it could also be configured with an omnidirectional antenna in alternative implementations.

The portion of the antenna component layer 1208 that overlaps the circuitry component layer 1206 substantially defines an interconnection region. The portion of the antenna component layer 1208 that includes radiating antenna elements substantially defines the radiating region and does not overlap the circuitry component layer 1206.

The communication device 1202 includes a display cover glass 1212, which is RF transparent, as is the edge surface 1232 and the back surface 1216 of the communication device case. A display assembly 1218 is positioned some distance from the top edge surface 1232 of the communication device 1202, and this RF transparent distance defines the RF transparent bezel region 1220. In contrast, the display assembly 1218 is not RF transparent and, therefore, will block all or most of the RF radiation from passing through the display assembly 1218 between the interior and exterior of the communication device 1202. Accordingly, all or more of the RF radiation may pass between the interior and exterior of the communication device 1202 through the RF transparent bezel region 1220. By positioning the antenna zone of the projected geometry antenna array component device 1200 within the RF transparent bezel region 1220, the directional RF radiation emitted from (and received by) the antenna element 1222 may pass between the interior and exterior of the communication device 1202 through cover glass 1212 within the RF transparent bezel region 1220.

It should be understood that, subject to thickness constraints imposed by the design of the communication device 1202, a second antenna component layer may be positioned on the opposite side of the circuitry component layer 1206 to provide directional RF radiation in the opposite direction of that from the antenna element 1222. Other configurations to provide multiple antenna arrays and supplemental RF radiation directions are contemplated as taught in the multiple implementations described herein.

FIG. 13 illustrates an example communication device 1300 for implementing the features and operations of the described technology. The communication device 1300 is may be a client device, such as a laptop, mobile device, desktop, tablet; a server/cloud device; an internet-of-things device; an electronic accessory; or another electronic device. The communication device 1300 includes one or more processor(s) 1302 and a memory 1304. The memory 1304 generally includes both volatile memory (e.g., RAM) and non-volatile memory (e.g., flash memory). An operating system 1310 resides in the memory 1304 and is executed by the processor(s) 1302.

In an example communication device 1300, as shown in FIG. 13, one or more modules or segments, such as communication software 1350, application modules, and other modules, are loaded into the operating system 1310 on the memory 1304 and/or storage 1320 and executed by processor(s) 1302. The storage 1320 may store communication parameters and other data and be local to the communication device 1300 or may be remote and communicatively connected to the communication device 1300.

The communication device 1300 includes a power supply 1316, which is powered by one or more batteries or other power sources and which provides power to other components of the communication device 1300. The power supply 1316 may also be connected to an external power source that overrides or recharges the built-in batteries or other power sources.

The communication device 1300 may include one or more communication transceivers 1330 which may be connected to one or more antenna(s) 1332 to provide network connectivity (e.g., mobile phone network, Wi-Fi®, Bluetooth®) to one or more other servers and/or client devices (e.g., mobile devices, desktop computers, or laptop computers). The communication device 1300 may further include a network adapter 1336, which is a type of communication device. The communication device 1300 may use the adapter and any other types of communication devices for establishing connections over a wide-area network (WAN) or local-area network (LAN). It should be appreciated that the network connections shown are exemplary and that other communication devices and means for establishing a communications link between the communication device 1300 and other devices may be used.

The communication device 1300 may include one or more input devices 1334 such that a user may enter commands and information (e.g., a keyboard or mouse). These and other input devices may be coupled to the server by one or more interfaces 1338, such as a serial port interface, parallel port, or universal serial bus (USB). The communication device 1300 may further include a display 1322, such as a touch screen display.

The communication device 1300 may include a variety of tangible processor-readable storage media and intangible processor-readable communication signals. Tangible processor-readable storage can be embodied by any available media that can be accessed by the communication device 1300 and includes both volatile and nonvolatile storage media, removable and non-removable storage media. Tangible processor-readable storage media excludes intangible communications signals and includes volatile and nonvolatile, removable and non-removable storage media implemented in any method or technology for storage of information such as processor-readable instructions, data structures, program modules or other data. Tangible processor-readable storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other tangible medium which can be used to store the desired information and which can be accessed by the communication device 1300. In contrast to tangible processor-readable storage media, intangible processor-readable communication signals may embody processor-readable instructions, data structures, program modules or other data resident in a modulated data signal, such as a carrier wave or other signal transport mechanism. The term "modulated data signal" means a signal that has one or more of its characteristics set or changed in such a manner as to encode information in the signal. By way of example, and not limitation, intangible communication signals include signals traveling through wired media such as a wired network or direct-wired connection, and wireless media such as acoustic, RF, infrared, and other wireless media.

While this specification contains many specific implementation details, these should not be construed as limitations on the scope of any inventions or of what may be claimed, but rather as descriptions of features specific to particular embodiments of a particular described technology. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

An example integrated antenna array device includes a circuitry component layer having bounds defining a circuitry zone, the circuitry component layer including beam steering circuitry, and an antenna component layer affixed to the circuitry component layer in the circuitry zone. The antenna component layer includes a radiating region and an interconnecting region. The radiating region is outside the circuitry zone and includes one or more antenna arrays having radiating antenna elements. The interconnecting region is substantially defined within the circuitry zone and interconnects the beam steering circuitry with the radiating antenna elements.

Another example integrated antenna array device of any preceding device is provided, wherein the interconnecting region includes a waveguide at least partially contained in the interconnecting region.

Another example integrated antenna array device of any preceding device is provided, wherein at least one of the radiating antenna elements includes a radiating aperture of the waveguide in the radiating region.

Another example integrated antenna array device of any preceding device is provided, wherein the waveguide includes an elongated dielectric material encased in conductive walls.

Another example integrated antenna array device of any preceding device is provided, wherein the beam steering circuitry feeds the waveguide via a tap inserted into dielectric material in the waveguide.

Another example integrated antenna array device of any preceding device is provided, wherein the antenna component layer includes two antenna arrays, each antenna array including directional radiating antenna elements.

Another example integrated antenna array device of any preceding device is provided, wherein the antenna component layer includes two antenna arrays, one antenna array including directional radiating antenna elements and the other antenna array including omnidirectional antenna elements.

Another example integrated antenna array device of any preceding device is provided, wherein the antenna component layer includes two antenna arrays, one antenna array including directional radiating antenna elements radiating in a first direction and the other antenna array including directional antenna elements radiating in a second direction, the first direction and second direction being mutually orthogonal.

Another example integrated antenna array device of any preceding device is provided, wherein the circuitry zone of the integrated antenna array device does not include a radiating antenna array.

An example communication device is provided having an interior and an exterior. The communication device includes a radiofrequency (RF) shielding display assembly on a display side of the communication device, a bezel region in the display side of the communication device between the RF shielding display assembly and an edge of the communication device, and an integrated antenna array device. The bezel region in the display side is capable of passing RF radiation between the interior and the exterior of the communication device. The integrated antenna array device includes a circuitry component layer having bounds defining a circuitry zone. The circuitry component layer includes beam steering circuitry. An antenna component layer is affixed to the circuitry component layer in the circuitry zone. The antenna component layer includes a radiating region and an interconnecting region. The radiating region is outside the circuitry zone and includes one or more antenna arrays having radiating antenna elements. The interconnecting region is substantially defined within the circuitry zone and interconnects the beam steering circuitry with the radiating antenna elements, wherein the radiating antenna elements are positioned in the bezel region of the communication device to allow the passing of RF radiation between the interior and the exterior of the communication device through the bezel region.

Another communication device of any preceding communication device is provided, wherein the interconnecting region of the integrated antenna array device includes a waveguide at least partially contained in the interconnecting region.

Another communication device of any preceding communication device is provided, wherein at least one of the radiating antenna elements includes a radiating aperture of the waveguide in the radiating region.

Another communication device of any preceding communication device is provided, wherein the waveguide includes an elongated dielectric material encased in conductive walls.

Another communication device of any preceding communication device is provided, wherein the beam steering circuitry feeds the waveguide via a tap inserted into dielectric material in the waveguide.

Another communication device of any preceding communication device is provided, wherein the antenna component layer of the integrated antenna array device includes two antenna arrays, each antenna array including directional radiating antenna elements.

Another communication device of any preceding communication device is provided, wherein the antenna component layer of the integrated antenna array device includes two antenna arrays, one antenna array including directional radiating antenna elements and the other antenna array including omnidirectional antenna elements.

Another communication device of any preceding communication device is provided, wherein the antenna component layer of the integrated antenna array device includes two antenna arrays, one antenna array including directional radiating antenna elements radiating in a first direction and the other antenna array including directional antenna elements radiating in a second direction, the first direction and second direction being mutually orthogonal.

Another communication device of any preceding communication device is provided, wherein the circuitry zone of the integrated antenna array device does not include a radiating antenna array.

Another communication device of any preceding communication device further includes one or more RF transparent materials in the bezel region of the display side of the communication device.

Another communication device of any preceding communication device further includes one or more RF transparent materials near the bezel region of the communication device on an edge or a non-display side of the communication device.

A number of implementations of the described technology have been described. Nevertheless, it will be understood that various modifications can be made without departing from the spirit and scope of the recited claims.

What is claimed is:

1. An integrated antenna array device comprising:

a circuitry component layer having bounds defining a circuitry zone, the circuitry component layer including beam steering circuitry; and an antenna component layer affixed to the circuitry component layer in the circuitry zone, the antenna component layer including a radiating region and an interconnecting region, the radiating region being outside the circuitry zone and including one or more antenna arrays having radiating antenna elements, the interconnecting region being substantially defined within the circuitry zone and interconnecting the beam steering circuitry with the radiating antenna elements, wherein the interconnecting region includes a waveguide.

2. The integrated antenna array device of claim 1, wherein the interconnecting region includes the waveguide at least partially contained in the interconnecting region.

3. The integrated antenna array device of claim 2, wherein at least one of the radiating antenna elements includes a radiating aperture of the waveguide in the radiating region.

4. The integrated antenna array device of claim 2, wherein the waveguide includes an elongated dielectric material encased in conductive walls.

5. The integrated antenna array device of claim 2, wherein the beam steering circuitry feeds the waveguide via a tap inserted into dielectric material in the waveguide.

6. The integrated antenna array device of claim 1, wherein the antenna component layer includes two antenna arrays, each antenna array including directional radiating antenna elements.

7. The integrated antenna array device of claim 1, wherein the antenna component layer includes two antenna arrays, one antenna array including directional radiating antenna elements and the other antenna array including omnidirectional antenna elements.

8. The integrated antenna array device of claim 1, wherein the antenna component layer includes two antenna arrays, one antenna array including directional radiating antenna elements radiating in a first direction and the other antenna array including directional antenna elements radiating in a second direction, the first direction and second direction being mutually orthogonal.

9. The integrated antenna array device of claim 1, wherein the circuitry zone of the integrated antenna array device does not include a radiating antenna array.

10. A communication device having an interior and an exterior, the communication device comprising:

a radiofrequency (RF) shielding display assembly on a display side of the communication device;

a bezel region in the display side of the communication device between the RF shielding display assembly and an edge of the communication device and being capable of passing RF radiation between the interior and the exterior of the communication device; and an integrated antenna array device including:

a circuitry component layer having bounds defining a circuitry zone, the circuitry component layer including beam steering circuitry, and an antenna component layer affixed to the circuitry component layer in the circuitry zone, the antenna component layer including a radiating region and an interconnecting region, the radiating region being outside the circuitry zone and including one or more antenna arrays having radiating antenna elements, the interconnecting region being substantially defined within the circuitry zone and interconnecting the beam steering circuitry with the radiating antenna elements, wherein the radiating antenna elements are positioned in the bezel region of the communication device to allow the passing of RF radiation between the interior and the exterior of the communication device through the bezel region.

11. The communication device of claim 10, wherein the interconnecting region of the integrated antenna array device includes a waveguide at least partially contained in the interconnecting region.

12. The communication device of claim 11, wherein at least one of the radiating antenna elements includes a radiating aperture of the waveguide in the radiating region.

13. The communication device of claim 11, wherein the waveguide includes an elongated dielectric material encased in conductive walls.

14. The communication device of claim 11, wherein the beam steering circuitry feeds the waveguide via a tap inserted into dielectric material in the waveguide.

15. The communication device of claim 10, wherein the antenna component layer of the integrated antenna array device includes two antenna arrays, each antenna array including directional radiating antenna elements.

16. The communication device of claim 10, wherein the antenna component layer of the integrated antenna array device includes two antenna arrays, one antenna array including directional radiating antenna elements and the other antenna array including omnidirectional antenna elements.

17. The communication device of claim 10, wherein the antenna component layer of the integrated antenna array device includes two antenna arrays, one antenna array including directional radiating antenna elements radiating in a first direction and the other antenna array including directional antenna elements radiating in a second direction, the first direction and second direction being mutually orthogonal.

18. The communication device of claim 10, wherein the circuitry zone of the integrated antenna array device does not include a radiating antenna array.

19. The communication device of claim 10 further comprising:

one or more RF transparent materials in the bezel region of the display side of the communication device.

20. The communication device of claim 10 further comprising:

one or more RF transparent materials near the bezel region of the communication device on an edge or a non-display side of the communication device.

* * * * *